US007706557B2

(12) United States Patent
Saltykov

(10) Patent No.: US 7,706,557 B2
(45) Date of Patent: Apr. 27, 2010

(54) CHAMBERS FOR A HEARING INSTRUMENT SHELL

(75) Inventor: Oleg Saltykov, Fairlawn, NJ (US)

(73) Assignee: Siemens Hearing Instruments Inc., Piscataway, NJ (US)

( * ) Notice: Subject to any disclaimer, the term of this patent is extended or adjusted under 35 U.S.C. 154(b) by 1080 days.

(21) Appl. No.: 11/374,229

(22) Filed: Mar. 13, 2006

(65) Prior Publication Data

US 2007/0223758 A1 Sep. 27, 2007

(51) Int. Cl.
*H04R 25/00* (2006.01)

(52) U.S. Cl. ..... 381/324; 381/322; 381/328

(58) Field of Classification Search ..... 381/322, 381/324, 325, 328, 380; 181/129, 130, 135
See application file for complete search history.

(56) References Cited

U.S. PATENT DOCUMENTS 4,854,415 A * 8/1989 Goschke ..... 381/324
7,130,437 B2 * 10/2006 Stonikas et al. ..... 381/322

* cited by examiner

*Primary Examiner*—Suhan Ni

(57) ABSTRACT

A portion of a hearing instrument housing or shell comprises one or more chambers having planar, conical, or convex walls. During assembly, this shape helps guide the receiver tube towards tip of the shell and the receiver tube hole. Additionally, it will reinforce the walls of the shell, decreasing the tendency of the shell to vibrate when the receiver is generating sound.

19 Claims, 9 Drawing Sheets

CHAMBERS FOR A HEARING INSTRUMENT SHELL

CROSS-REFERENCE TO RELATED APPLICATIONS

This application is related to the following U.S. patent applications, incorporated herein by reference:

Ser. No. 09/887,939 filed Jun. 22, 2001;
Ser. No. 10/218,013 filed Aug. 13, 2002;
Ser. No. 10/610,449 filed Jun. 30, 2003; and
Ser. No. 10/945,704 filed Sep. 21, 2004.

BACKGROUND AND SUMMARY OF THE INVENTION

Hearing instruments, i.e., devices that assist the hearing impaired, designed for complete or partial insertion into the user's ear canal, have a shell or housing that holds various components. One such component is the receiver, the element that generates the sound heard by the instrument's user. The sound is carried from the receiver by a receiver tube affixed to a port on the receiver to an opening (the receiver tube hole) in the tip of the shell, the portion of the hearing instrument positioned in the ear canal towards the eardrum.

During assembly, the receiver and its receiver tube are inserted into the shell, receiver tube first, and the tube is passed through the receiver tube hole. Once the receiver is in place inside the shell, anchored by a support, any excess portion of the receiver tube protruding from the shell is removed.

During assembly, the receiver tube is inserted into the shell and aimed towards the receiver tube hole. Occasionally, the end of the tube misses the receiver tube hole and catches on the inside of the shell. In that instance, the receiver tube must be pulled out and reinserted in an attempt to pass the tube through the receiver hole.

An Improved Configuration for the Inside of the Shell

The problem mentioned above may be minimized by providing an inwardly-sloping contour inside the shell of the hearing instrument. In particular, the interior of at least a portion of the shell comprises a chamber having planar or conical surfaces or inwardly curving or convex surfaces that guide the receiver tube towards the tip of the shell and the receiver tube hole.

Depending on the size and length of the hearing instrument, the shell may contain more than one such chamber. For example, where there are two chambers, the receiver tube is inserted into and through the first chamber and the tube then passes through an optional interconnecting passage and into and through the second chamber. A stopper having dimensions greater than the interconnecting passage may be provided on the receiver tube. When the stopper meets the end of the first chamber, the tube will not travel further into the shell, fixing the location of the receiver in the shell. A stopper may also be provided for a shell having a single chamber.

The design discussed here will improve the assembly process. An additional benefit achieved by the configurations discussed here is that walls of the shell are reinforced, reducing any tendency of the walls to vibrate.

DESCRIPTION OF THE INVENTION

Figure 1:
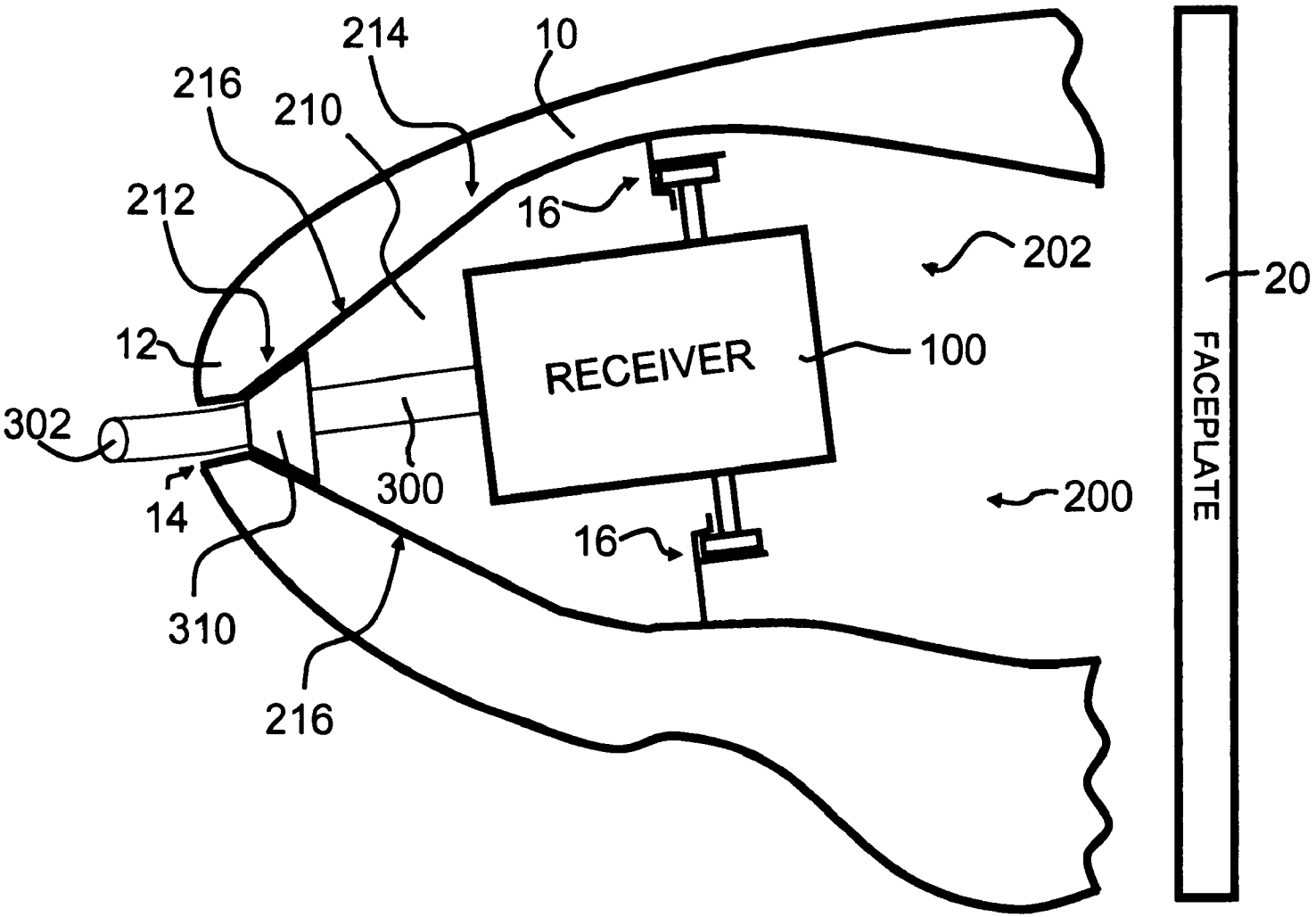
FIGS. 1 and 2 are partial cross-sectional views of hearing instrument shells comprising a single chamber.

FIG. 1 is a partial cross-sectional view of a hearing instrument shell or housing 10, comprising a tip 12 to be inserted into the ear canal of the person wearing the hearing instrument. The other end of the shell 10, on the right side of FIG. 1, shown incomplete in this as well as the other figures, is where the faceplate 20 (shown schematically here) would be attached. The faceplate 20 is the portion of the hearing instrument that faces generally outwardly from the ear proper, and at least a portion of the faceplate 20 is typically visible in the outer ear. In addition to an opening to admit sound, the faceplate 20 may also contain a battery door and a volume control. The faceplate may be fabricated as an integral component of the housing or shell 10 or it may be a separate part attached to the housing or shell 10 during assembly.

A receiver assembly 100 is positioned in the interior 200 of the shell 10 and may be mounted there using anchors 16 such as those described in U.S. application Ser. No. 10/945,704 and schematically depicted here in FIG. 1. A flexible receiver tube 300, having a degree of resilience and compliance, conveys the sound generated by the receiver 100 to the outside of the instrument housing 10. The receiver tube 300 is attached to the receiver assembly 100 and the end 302 of the receiver tube 300 passes through a receiver tube hole 14 in the tip 12 of the shell 10.

At least a portion of the shell interior 200 is a forward chamber 210 located in the tip 12 of the hearing instrument shell 10. As illustrated in FIG. 1, the forward chamber 210 is oriented such that the narrow end 212 of the chamber 210 is near the tip 12 and adjoins the receiver tube hole 14; the wide end 214 of the chamber 210 is closer to the faceplate 20.

The dimensions of the cross-section of the narrow end 212 are approximately the same as the dimensions as the cross-section of the adjoining receiver tube hole 14. Depending on design and space considerations, the receiver 100 may reside at least partially within the forward chamber 210.

Figure 2:
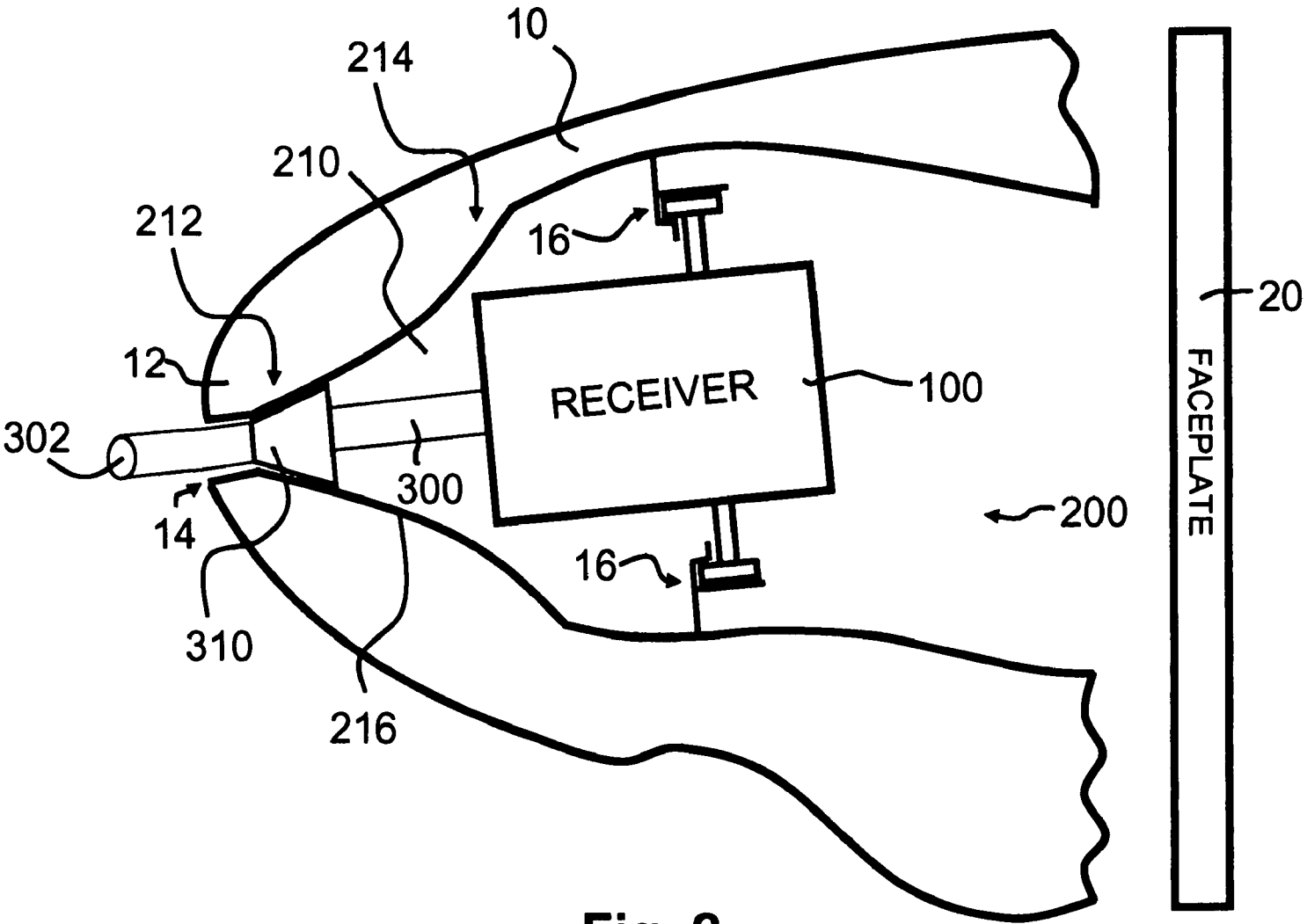

In the configuration illustrated in FIG. 1, the opposing, interior walls or surfaces 216 of the forward chamber 210 are depicted as straight lines, the walls 216 extending from the narrow end 212 of the chamber towards the wide end 214. In such a case, those surfaces 216 may be conical or planar. The geometry of the chamber 210 would then be either conical or polyhedral, respectively, and may be truncated at the receiver tube hole 14. Also, a chamber 210 comprising a polyhedral contour may have sides (i.e., portions of the walls 216) of equal or unequal dimensions. Alternatively, the walls or surfaces 216 may curve inwardly, defining convex surfaces such as a hyperboloid (technically, one-half of a hyperboloid), as illustrated in FIG. 2.

The entire chamber 210 or a portion of the chamber 210 may exhibit the desired planar, conical, or convex shape. In FIG. 1, however, only the portion of the chamber 210 closest to the tip 12 has this shape (i.e., planar or conical). The rear portion 202 of the shell interior 200, where the bulk of the receiver 100 is positioned, follows the outer contour of the shell 10 to a greater or lesser degree. Similarly, only the portion of the chamber 210 illustrated in FIG. 2 adjacent to the tip 12 has a convex contour.

If desired, a stopper 310 may be provided for the receiver tube 300, as shown in FIG. 1. The stopper 310 may be an integral part of the receiver tube 300 or an added piece that sits on the outside of the tube 300. As appropriate, the shape of the stopper 310 can be fashioned to conform to the shape of the walls 216 of the forward chamber 210 or it can assume the shape of a truncated cone (also known as a conical frustrum), a torus, a sphere, or some other suitable configuration.

Figure 3:
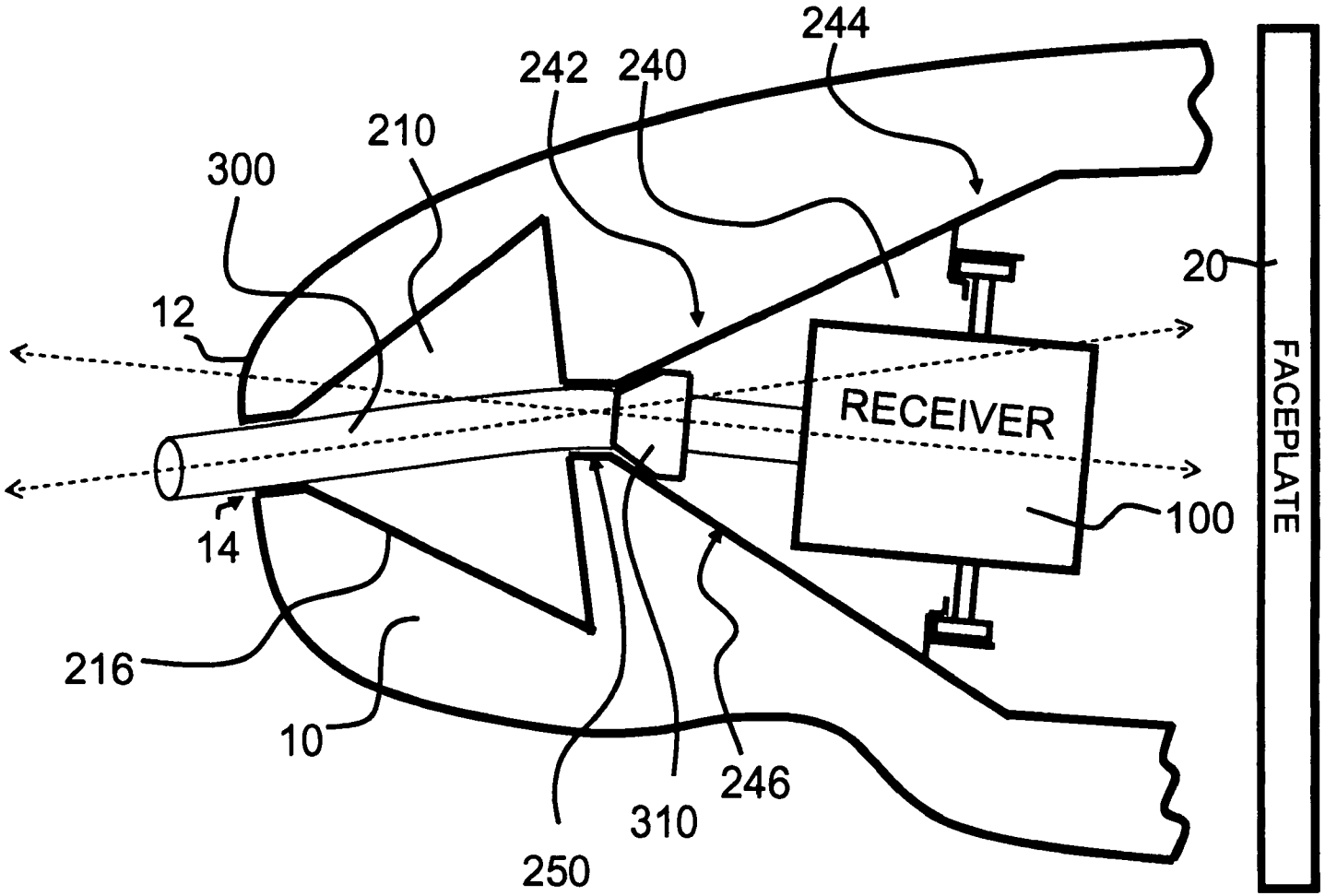
FIGS. 3, 4, 5, and 6 are partial cross-sectional views of hearing instrument shells comprising two chambers.
Figure 4:
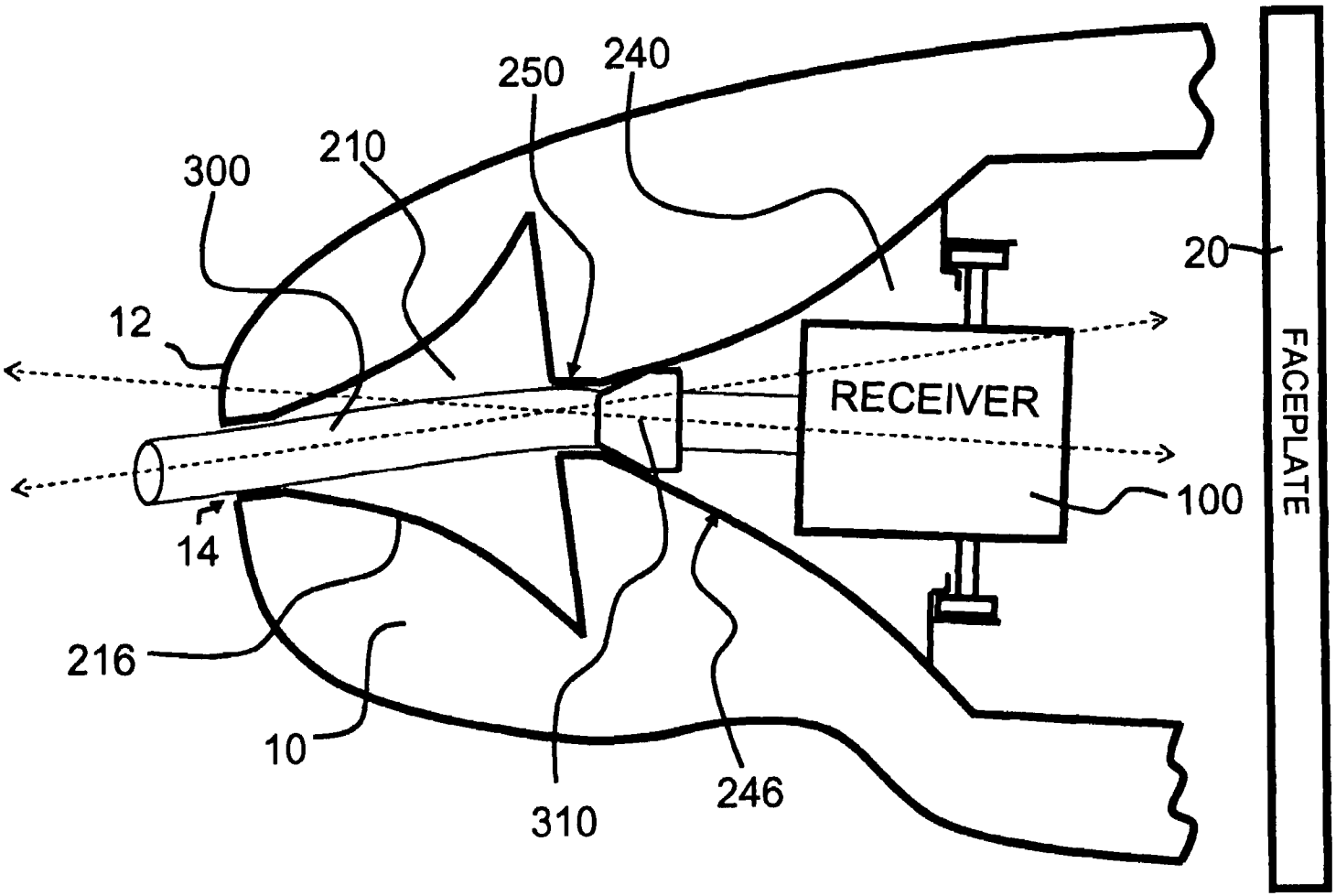

An intermediate chamber 240 may also be provided behind the forward chamber 210 (i.e., between the forward chamber 210 and the faceplate 20), as shown in FIG. 3. The walls or surfaces 246 of the intermediate chamber 240 may be planar (or conical) as shown in FIG. 3 or curved inwardly, i.e., convex, as depicted in FIG. 4, and the entire chamber 240 or a portion of the chamber 240 may exhibit this shape. In either case, the intermediate chamber 240 is oriented such that the narrow end 242 of the intermediate chamber 240 is closer to the tip 12; the wide end 244 of the chamber 240 is closer to the faceplate 20. Again, a stopper 310 can be provided for the receiver tube. In this instance, it would be located in the intermediate chamber 240, closer to the receiver 100 and further from the tip 12 of the shell 10.

If desired, instead of an immediate transition from the intermediate chamber 240 to the forward chamber 210, an interconnecting channel 250 (see FIG. 3 or 4) can be provided between the intermediate chamber 240 and the forward chamber 210. In this arrangement, the receiver tube 300 passes through the intermediate chamber 240, the interconnecting channel 250, and then the forward chamber 210. Alternatively, the intersection between the two chambers 210 and 240 can be abrupt, with no interconnecting passage.

Figure 5:
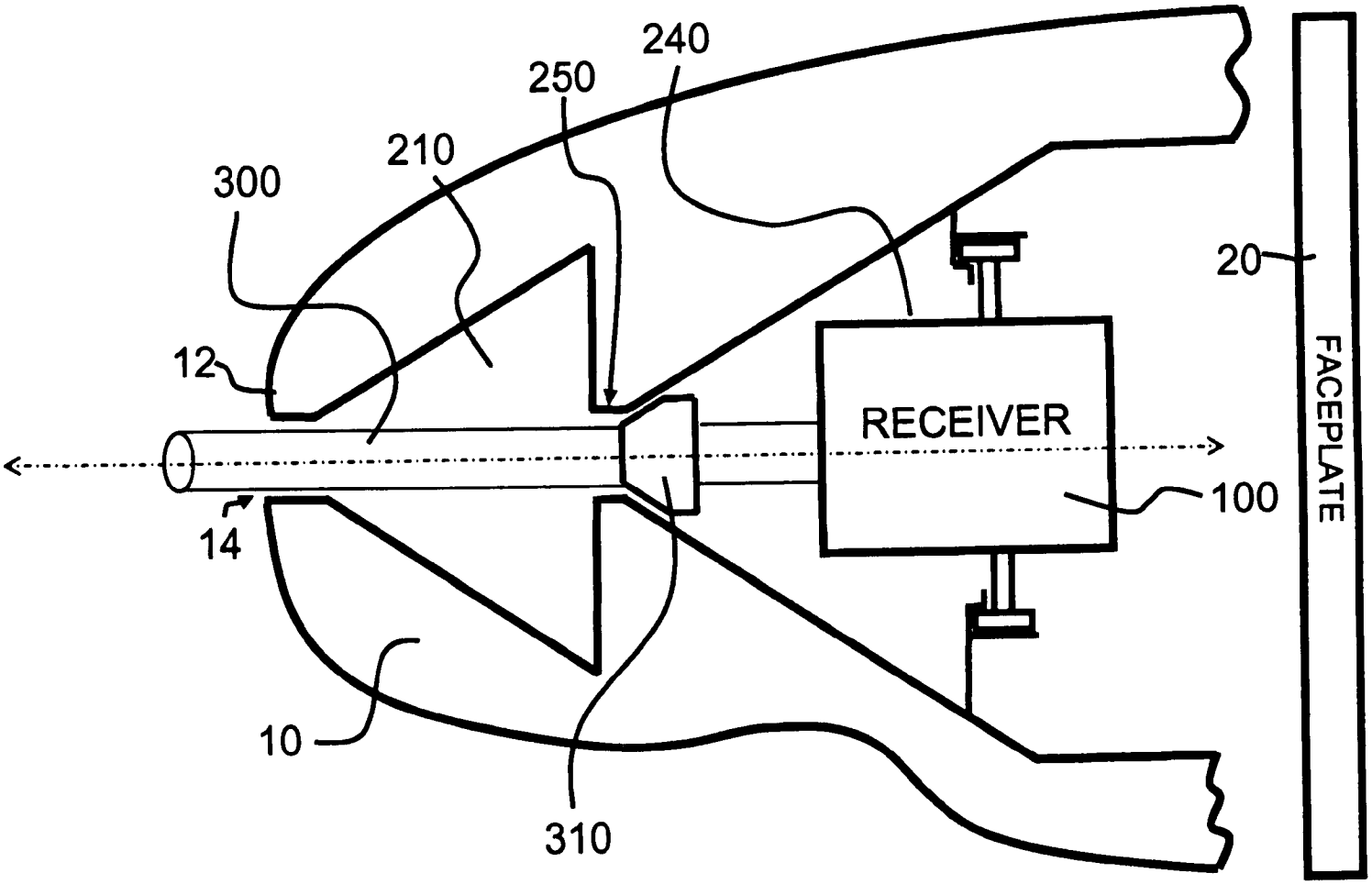

Depending on the outer shape of the shell 10, the forward and intermediate chambers 210 and 240 may be collinear, as illustrated in FIG. 5 and evidenced by the relatively straight receiver tube 300 (note the dashed line denoting the axis of the receiver 100 and the receiver tube 300), or they may lie on different axes as illustrated in FIGS. 3 and 4 (note the dashed lines representing the axes of the two chambers).

Figure 6:
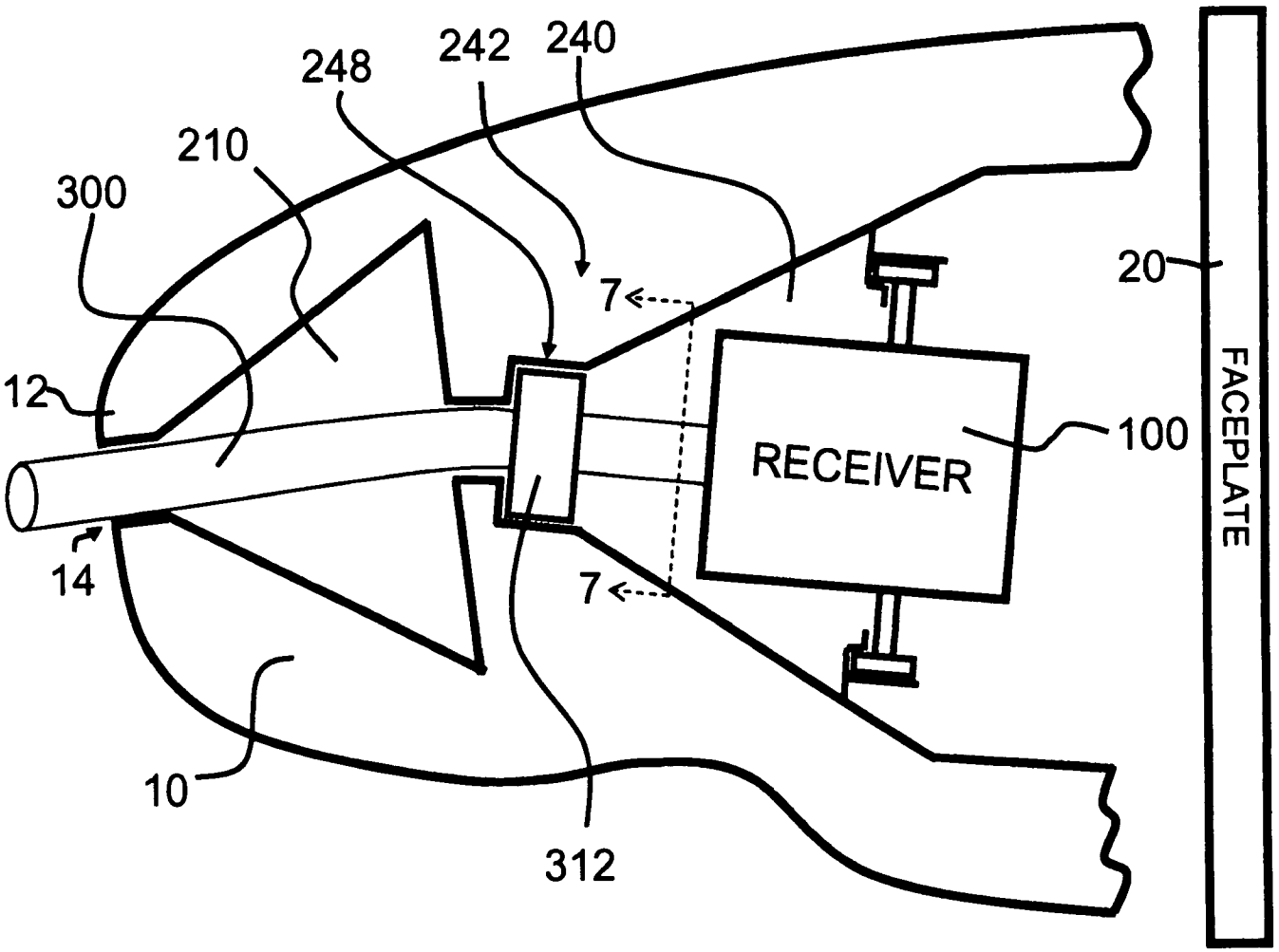
Figure 7:
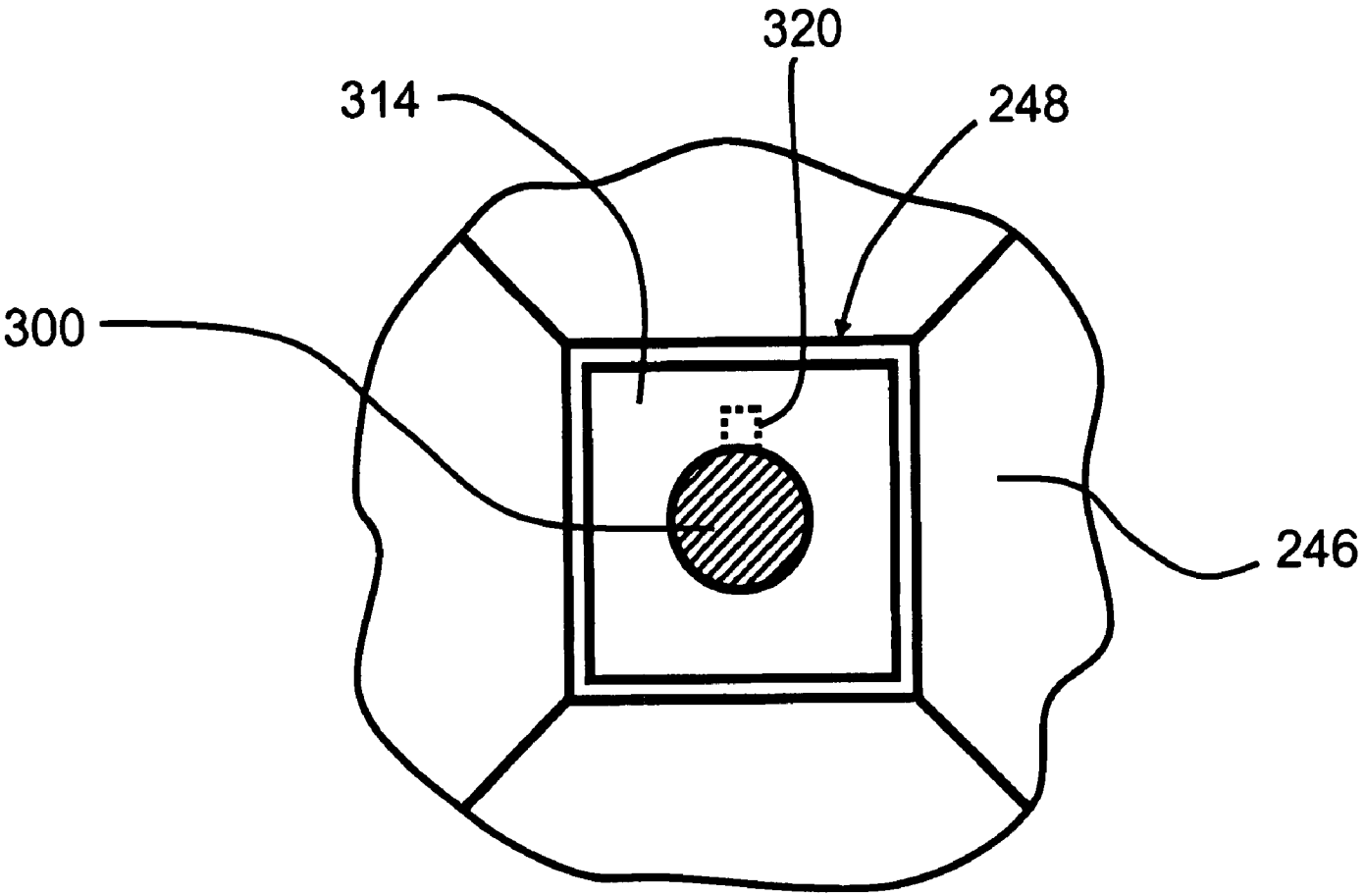
FIG. 7 is a partial axial cross-sectional view of a chamber and a conforming stopper for a receiver tube.

To accommodate the particular shape of the chambers, the stoppers 310 illustrated in FIGS. 1-5 conform to the taper of the walls (216 or 246). As an alternative, a recess 248 can be provided for the stopper 312 as shown in FIG. 6 at the narrow end 242 of the intermediate chamber 240. Here, the recess 248 provides a conforming receptacle having a generally rectangular profile for a stopper 312 having a similarly non-tapered profile, such as a torus. As an additional refinement, the stopper may assume the form of a polyhedron, such as the stopper 314 illustrated in FIG. 7. Here, the walls 246 of the shell 10 are planar, defining four of five surfaces of a pentahedral chamber. In this particular case, the stopper 314 must be positioned in one of four possible orientations (i.e., at 0, 90, 180, or 270 degrees), radially orienting the receiver 100 (not shown in this view). Alternatively or in addition, a locating spline and keyway (shown collectively in FIG. 7 in phantom as element 320 and described in U.S. application Ser. No. 10/218,013) could be provided on the receiver tube 300 and the interconnecting channel 250, respectively, or on the stopper 312 and the recess 248 of FIG. 6, respectively.

In FIGS. 1-6, the chambers 210 and 240 assume a single shape or contour, whether the walls are planar or convex surfaces. In a particularly small hearing instrument, there may be a desire to move the receiver 100 as close as possible to the tip 12 to maximize the use of space within the shell interior 200. This may be achieved by flaring a portion of the walls or surfaces of the chamber, either in the forward chamber 210 or the intermediate chamber 240, or both, creating a second angular profile or contour, whether planar, conical, or convex, within the same chamber.

Figure 8:
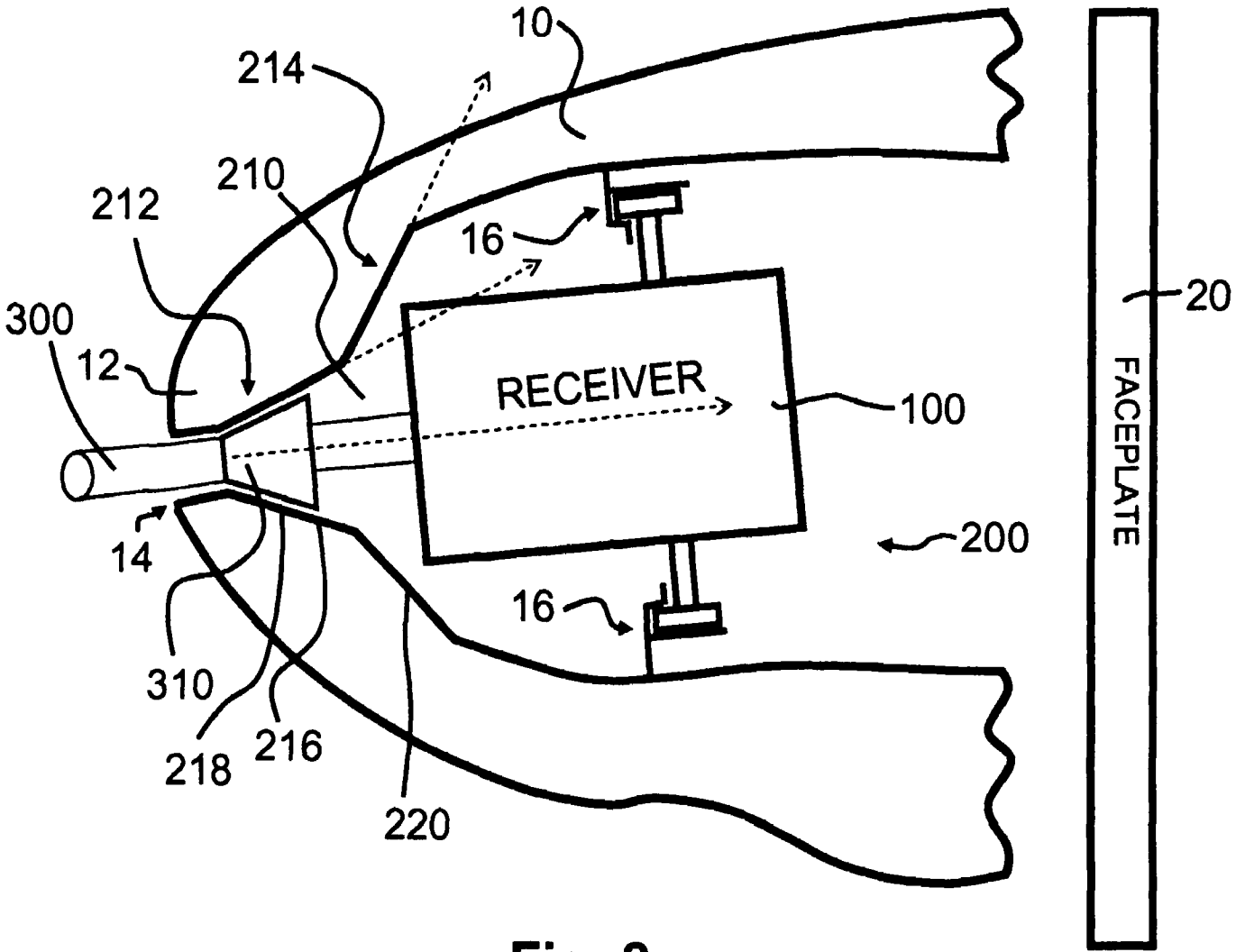
FIGS. 8 and 9 are partial cross-sectional views of a hearing instrument shell comprising a chamber having multiple angular profiles or contours.
Figure 9:
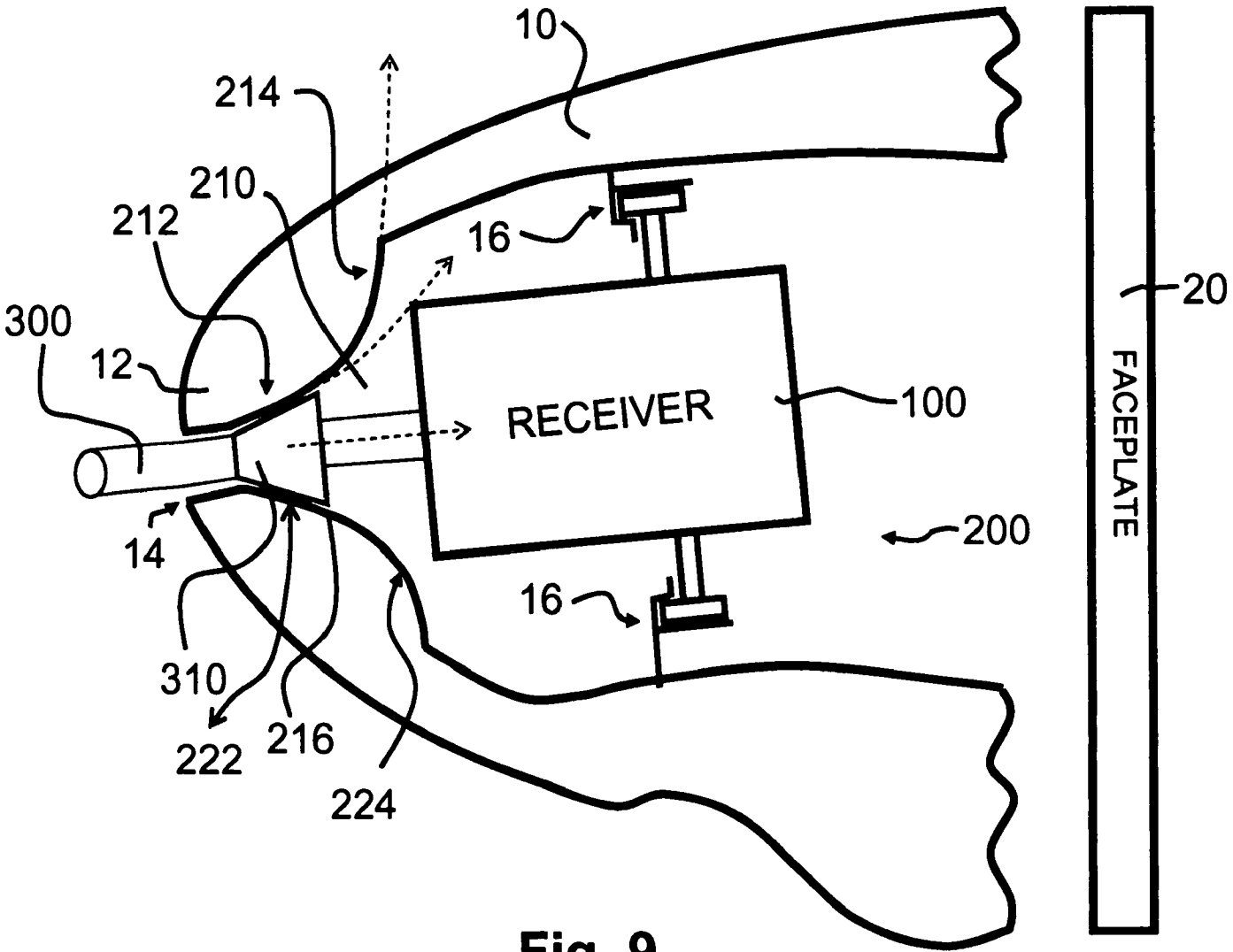

In FIG. 8, the angular orientation of the walls 216 at the narrow end 212 of the chamber 210 with respect to the axis of the chamber 210 defines one angle or a first angular contour 218, while the portion at the wide end 214 of the chamber 210 defines a greater angle or a second angular contour 220 (note the dashed lines). Similarly, in FIG. 9, distinct inwardly curved (or, convex or hyperboloidal) contours or surfaces 222 and 224, exhibiting different degrees of curvature relative to the axis of the chamber 210, are illustrated for the narrow and wide ends 212 and 214 of the chamber 210, respectively (again, note the dashed lines).

If desired, planar, conical, and convex walls could be used in combination for the multiple contours, e.g., one planar and one convex, or planar and conical, or convex and conical, within the same chamber. Additionally, the chambers 210 and 240 could be divided into more than two sections, such that there are three or more contours or shapes from one end of the chamber (210 or 240) to the other. Also, the walls or surfaces within the same section of the chamber could be a combination of planar and convex contours. Finally, a shell could have more than two chambers, e.g., a very long shell.

Assembly of the shells is enhanced with the configurations of FIGS. 1-9. In each case, the free end 302 of the receiver tube 300, i.e., the end not attached to the receiver 100, is inserted into the intermediate chamber 240, if one has been provided, through an interconnecting channel 250 if present, and then into the forward chamber 210, and towards the receiver tube hole 14, and then through the receiver tube hole 14. The contours of the walls or surfaces in the forward and intermediate chambers 210 and 240 guide the free end 302 of the receiver tube 300 through the chamber 200, without fear of having the end 302 catch against the inside of the shell 10.

The receiver tube 300 and the stoppers 310 and 312 may be fabricated from a synthetic material such as an elastomer or any other suitable material. One such elastomer is marketed by DuPont Dow Elastomers, L.L.C. under the trademark Viton.

What is claimed is:

1. A hearing instrument, comprising:
- a receiver assembly comprising a receiver tube; and
- a shell, for insertion into the ear canal of a user, comprising
  - a tip comprising a receiver tube hole for removably receiving the receiver tube, the receiver tube hole comprising a cross-section; and
  - a forward chamber, through which the receiver tube passes, comprising
    - a narrow end, where the narrow end adjoins the receiver tube hole and comprises a cross-section having dimensions approximately equal to the dimensions of the cross-section of the receiver tube hole;
    - a wide end; and
    - opposing, interior walls between the narrow and wide ends comprising planar, conical, or convex surfaces extending from the narrow end of the chamber.

2. A hearing instrument as set forth in claim 1, where the opposing, interior walls comprise a combination of surfaces, the combination comprising at least two of the following: planar, conical, and convex surfaces.

3. A hearing instrument as set forth in claim 1, where
- the chamber comprises an axis;
- the opposing, interior walls comprise a plurality of planar and/or conical surfaces; and
- the planar and/or conical surfaces define a plurality of angular contours relative to the axis of the chamber.

4. A hearing instrument as set forth in claim 1, where
- the chamber comprises an axis;

the opposing, interior walls comprise a plurality of convex surfaces; and the convex surfaces define a plurality of degrees of curvature relative to the axis of the chamber.

5. A hearing instrument as set forth in claim 1, further comprising an intermediate chamber, where the intermediate chamber contains the receiver and comprises a narrow end connected to the wide end of the forward chamber;

a wide end; and opposing, interior walls between the narrow and wide ends comprising planar, conical, or convex surfaces extending from the narrow end of the intermediate chamber.

6. A hearing instrument as set forth in claim 5, further comprising a faceplate, where the intermediate chamber is located between the forward chamber and the faceplate.

7. A hearing instrument as set forth in claim 5, further comprising an interconnecting channel between the forward and intermediate chambers.

8. A hearing instrument as set forth in claim 1, where the receiver tube comprises a stopper located on the tube at a predetermined distance from the receiver, the stopper comprising an outer surface that mates with a portion of the narrow end of the chamber.

9. A housing for a hearing instrument, for insertion into the ear canal of a user, comprising a receiver assembly comprising a receiver tube, comprising:

a tip comprising a receiver tube hole for removably receiving the receiver tube, the receiver tube hole comprising a cross-section; and a forward chamber, through which the receiver tube passes, comprising a narrow end, where the narrow end adjoins the receiver tube hole and comprises a cross-section having dimensions approximately equal to the dimensions of the cross-section of the receiver tube hole;

a wide end; and opposing, interior walls between the narrow and wide ends comprising planar, conical, or convex surfaces extending from the narrow end of the chamber.

10. A housing for a hearing instrument as set forth in claim 9, where the opposing, interior walls comprise a combination of surfaces, the combination comprising at least two of the following: planar, conical, and convex surfaces.

11. A housing for a hearing instrument as set forth in claim 9, where the chamber comprises an axis;

the opposing, interior walls comprise a plurality of planar and/or conical surfaces; and the planar and/or conical surfaces define a plurality of angular contours relative to the axis of the chamber.

12. A housing for a hearing instrument as set forth in claim 9, where the chamber comprises an axis;

the opposing, interior walls comprise a plurality of convex surfaces; and the convex surfaces define a plurality of degrees of curvature relative to the axis of the chamber.

13. A housing for a hearing instrument as set forth in claim 9, further comprising an intermediate chamber, where the intermediate chamber contains the receiver and comprises a narrow end connected to the wide end of the forward chamber;

a wide end; and opposing, interior walls between the narrow and wide ends comprising planar, conical, or convex surfaces extending from the narrow end of the intermediate chamber.

14. A housing for a hearing instrument as set forth in claim 13, further comprising a faceplate, where the intermediate chamber is located between the forward chamber and the faceplate.

15. A housing for a hearing instrument as set forth in claim 13, further comprising an interconnecting channel between the forward and intermediate chambers.

16. A housing for a hearing instrument as set forth in claim 9, where the receiver tube comprises a stopper located on the tube at a predetermined distance from the receiver, the stopper comprising an outer surface that mates with a portion of the narrow end of the chamber.

17. A hearing instrument, comprising:

a receiver assembly comprising a receiver tube;

a shell, for insertion into the ear canal of a user, comprising a tip comprising a receiver tube hole for removably receiving the receiver tube, where the receiver tube hole comprises a cross-section; and interconnected forward and intermediate chambers, each chamber comprising opposing, inner walls defining a truncated cone section comprising wide and narrow ends, where the narrow end of the forward chamber adjoins the receiver tube hole in the tip, the narrow end comprising a cross-section having dimensions approximately equal to the dimensions of the cross-section of the receiver tube hole;

the wide end of the forward chamber is connected to the narrow end of the intermediate chamber; and the receiver resides in the intermediate chamber and a portion of the receiver tube resides in the forward chamber.

18. A hearing instrument as set forth in claim 17, further comprising a faceplate, where the intermediate chamber is located between the forward chamber and the faceplate.

19. A hearing instrument as set forth in claim 17, further comprising an interconnecting channel between the forward and intermediate chambers.

* * * * *